United States Patent [19]

Mizuno et al.

[11] 4,415,828

[45] Nov. 15, 1983

[54] SPARKPLUG WITH ANTIFOULING COATING ON DISCHARGE END OF INSULATOR

[75] Inventors: Hisao Mizuno; Shunichi Takagi; Kichio Nakahara; Takahito Yamamota, all of Aichi, Japan

[73] Assignee: NGK Spark Plug Co., Ltd., Aichi, Japan

[21] Appl. No.: 285,242

[22] Filed: Jul. 20, 1981

[30] Foreign Application Priority Data

Jul. 22, 1980 [JP] Japan ..... 55-100143
Jul. 29, 1980 [JP] Japan ..... 55-107097[U]

[51] Int. Cl.[3] ..... H01T 13/20
[52] U.S. Cl. ..... 313/118; 313/143
[58] Field of Search ..... 313/118, 143

[56] References Cited

U.S. PATENT DOCUMENTS 4,267,483 5/1981 Nakajima et al. ..... 313/143
4,337,408 6/1982 Sone et al. ..... 313/143 X

FOREIGN PATENT DOCUMENTS 2109415 9/1972 Fed. Rep. of Germany ..... 313/118

*Primary Examiner*—Palmer C. Demeo
*Attorney, Agent, or Firm*—Sughrue, Mion, Zinn, Macpeak and Seas

[57] ABSTRACT

A sparkplug having an improved antifouling performance and in which a decrease in insulation resistance is prevented, even if an electrically conductive material is deposited on the firing surface of the insulator of the sparkplug. In accordance with the invention, a coating of a solution of silicone and paraffin is formed on at least the portion of the firing surface of the porcelain insulator which is surrounded by the inner surface of the combustion chamber side of the metal casing of the sparkplug. Preferably, the coating is also formed on the inner surface of the metal casing.

8 Claims, 7 Drawing Figures

SPARKPLUG WITH ANTIFOULING COATING ON DISCHARGE END OF INSULATOR

BACKGROUND OF THE INVENTION

The present invention relates to a sparkplug having good antifouling properties for use in internal combustion engines.

If the temperature of the tip of the firing leg of the porcelain insulator in a sparkplug is less than 500° C., there is a tendency for carbon, water and other electrically conducting materials to be deposited on the firing surface. Moreover, if the insulation resistance between the electrodes becomes lower than 1 MΩ, a spark cannot easily be formed and normal spark discharge then cannot occur. This phenomenon (misfiring) is apt to occur if electrically conductive materials are deposited on the firing surface of the porcelain insulator as a result of repeated short cycles of idling or running at low speeds or before a new car has been run 1000 km.

An antifouling sparkplug is known that has a coating of heat-resistant, insulating material on the inner surface of the combustion chamber side of the metal casing to prevent short-circuiting between the firing surface of the porcelain insulator and the metal casing. It has been proposed to use silicone oil as such a heat-resistant, insulating material. In such a case, a coating of silicone oil is formed on the inner surface of the metal casing and the firing surface of the porcelain insulator. However, subsequent studies have revealed that a coating of silicone oil alone is not effective in preventing the decrease in insulation resistance. Specifically, silicone has a chain combination —Si—O—Si—O— which makes the coating gas-permeable. Therefore, if a silicone coating is formed on the inner surface of the metal casing or the firing surface of the porcelain insulator, carbon or water can penetrate therethrough making the silicone coating electrically conductive. As a result, the insulation between the firing surface of the porcelain insulator and the metal casing is impaired thus reducing the antifouling properties of the sparkplug.

SUMMARY OF THE INVENTION

Therefore, an object of the invention is to provide a sparkplug having good antifouling properties, effectively preventing a decrease in insulation resistance even if an electrically conductive material is deposited on the firing surface of the porcelain insulator.

This and other objects of the invention are achieved by forming a coating of a solution of silicone and paraffin on at least the portion of the firing surface of the porcelain insulator which is surrounded by the inner surface of the combustion chamber side of the metal casing. Also, the coating may be formed from a solution of fluorine oil containing fluorine on an elemental basis.

DESCRIPTION OF THE PREFERRED EMBODIMENTS

The invention will hereafter be described specifically by reference to the accompanying drawings.

Figure 1:
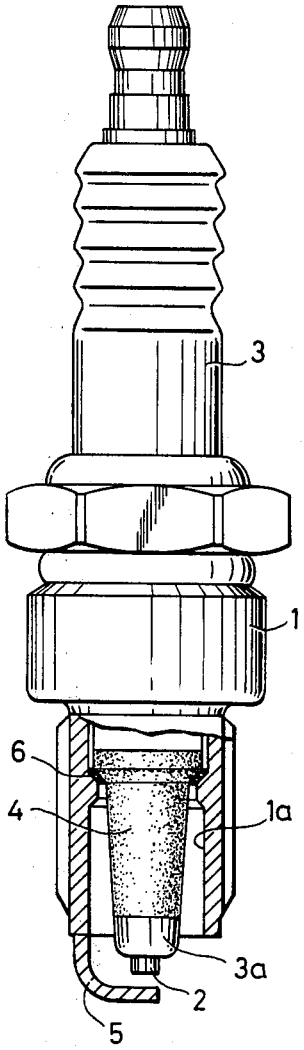
FIG. 1 is a sectional view of a sparkplug to which the invention is applied.

FIG. 1 is an elevational section of essential parts of a sparkplug according to a first embodiment of the invention. In FIG. 1, reference numeral 1 indicates a metal casing, 2 a central electrode, and 3 a high-alumina content porcelain insulator for holding the central electrode 2 in the interior. The insulator 3 rests in the metal casing and is sealed and is fixed with a packing 6 by a known method. The insulator 3 has a firing section 3*a* on the inner surface 1*a* of the combustion chamber side of the metal casing 1. The surface of the firing section 3*a* has a coating 4 according to the invention. A side electrode 5 is connected at the underside of the metal casing 1 to form a spark gap with the central electrode 2.

The coating 4 is formed of a solution of silicone and paraffin. As described above, a silicone coating alone is gas-permeable so that when an electrically conductive material is deposited on such a coating, the insulation resistance between the electrodes is decreased. To avoid this problem, the coating 4 has insulating paraffin embedded in the gas-permeable area of the silicone to provide uniformly increased insulation and water-resistance throughout the coating.

In the conventional sparkplug having no insulation coating on the firing surface of the porcelain insulator, electrically conductive materials such as carbon and water are inherently easily deposited on the firing surface and the particles thereof coalesce to form a continuous deposit that causes a sudden decrease in the insulation resistance. In contrast, the coating 4 according to the invention is inherently resistant to deposition of electrically conductive materials. Even if such materials are deposited, particles thereof are round and an insulating distance between the particles is maintained so that a decrease in insulation resistance is effectively prevented.

To provide a uniform coating 4 having a high insulating effect, silicone and paraffin must be diluted with a solvent that dissolves both of them. Examples of such a solvent include trichloroethylene, chlorobenzene, trichlorotrifluoroethane, toluene, xylene, ligroin petroleum and benzene. Silicone oil, which is easy to handle and mix with other materials, is desirable as the silicone component. A paraffinic hydrocarbon (sometimes collectively referred to as paraffins) or a eutectic mixture of paraffins with polyethylene or polystyrene may be used as the paraffin component.

EXAMPLE 1

Figure 2:
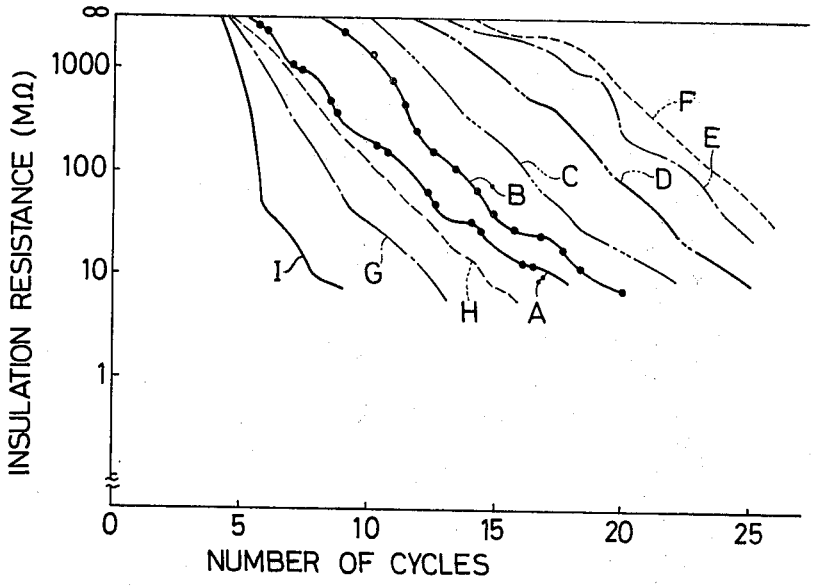
FIG. 2 is a series of graphs for comparing the performance of sparkplug of the invention with prior art sparkplugs.

A saturated solution of solid paraffin (100 cc) in trichloroethylene was mixed with 0.1 cc, 1 cc, 25 cc and 50 cc of silicone oil to form samples of coating solution A, B, C, D, E and F. These solutions were applied to the firing surface of porcelain insulators which were left to stand for 24 hours and installed in metal casing to thus prepare six sparkplugs A, B, C, D, E and F. For comparison purposes, a sparkplug G the firing surface of which was coated with a solution of paraffin in Trichloroethylene, a sparkplug H the firing surface of which was coated with 10 cc of silicone oil in trichloroethylene, and a prior art sparkplug I having no insulation coating were prepared. The nine sparkplugs were subjected to an antifouling tests, the results of which are shown in FIG. 2. In the test, a 4-cycle single cylinder engine was used. Cycles composed of a 50-second idling period (2070 rpm, $\frac{3}{4}$ choking) with rich air/fuel mixture, five racings at full throttle, and an operation stop period of two minutes were repeatedly performed.

As shown in FIG. 2, the sparkplug G and H having coatings of only paraffin and silicone, respectively, proved more resistant to antifouling than the prior art sparkplug I. However, neither plug has antifouling properties that met the desired requirements. The sparkplug A to F having coatings of silicone and paraffin according to the invention withstood more test cycles than the comparative samples and had an acceptable antifouling performance.

Thus the objects of the invention are achieved fully by providing a coating of at least 0.1% of silicone on the basis of a saturated paraffin solution, and desirably, about 5 to 50% of silicone mixed with paraffin. Adding more than 50% of silicone results in the formation of an uneven and too thick coating and is a waste of material. Experiments have confirmed that the same result is obtained with the sparkplugs A to F when they were used in a commercial automobile that was subjected to repeated cycles of idling and low-speed (10–20 km/hr) running at a temperature of −10° C.

Figure 3:
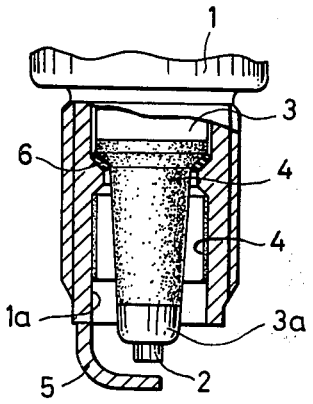
FIG. 3 is an enlarged view of part of FIG. 1.

In a modification of the first embodiment of the invention, the coating 4 may be formed not only on the firing surface 3*a* of the porcelain insulator 3 but also on the inner surface 1*a* of the metal casing as shown in FIG. 3. The objects of the invention can also be achieved by forming the coating 4 only on the firing surface 3*a* of the porcelain insulator 3 as shown in FIG. 1. However, by forming the coating 4 on the inner surface 1*a* of the metal casing 1 also, short-circuiting between the firing surface and the metal casing is prevented and the antifouling performance of the sparkplug is enhanced further. The coating 4 can be formed on both the firing surface 3*a* and inner surface is of the metal casing 1 by charging the coating solution into the annular space around the firing section of a porcelain insulator installed in the metal casing.

As described above, a sparkplug of the invention has a coating of silicone and paraffin on at least the firing surface of a porcelain insulator. As a result, electrically conductive materials such as carbon and water are not easily deposited on the firing surface, even after repeated engine running at low speed or under low load. Even if such materials are deposited, the insulation resistance between the electrodes is maintained high, providing effective protection against rapid fouling of the sparkplugs of a new car.

As described above, the antifouling properties of a sparkplug can be effectively increased by forming a coating of silicone oil and paraffin on the firing surface of a porcelain insulator. However, it has been found that if the tip of the firing section of the insulator is covered with such a coating, the ability of the tip to burn off carbon deposits (self cleaning) decreases.

To overcome this difficulty, in a second embodiment of the invention illustrated below a sparkplug is provided having improved antifouling and self-cleaning properties. This object is achieved by forming a coating of silicone oil and paraffin on the firing surface except for the tip of the porcelain insulator surrounded by the inner surface of the combustion chamber side of the metal casing, or on both such firing surface and the inner surface of said metal casing.

Figure 4:
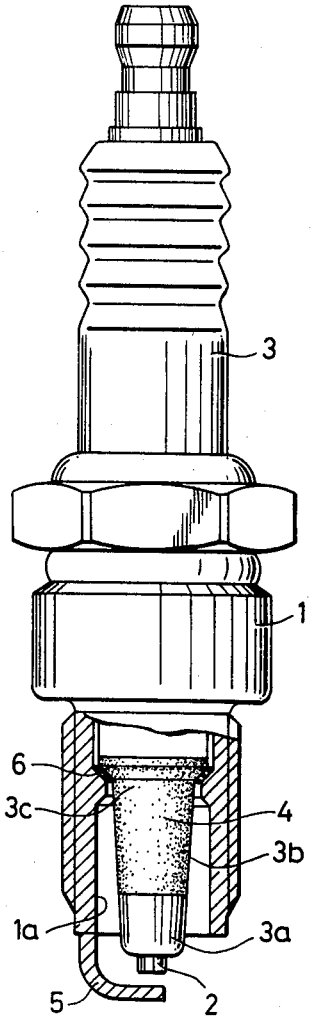
FIG. 4 is a sectional view showing another sparkplug to which the invention is applied.

FIG. 4 is an elevational section of essential parts of a sparkplug according to the second embodiment of the invention wherein the same components as shown in FIGS. 1 and 3 are identified by the same reference numerals. A coating 4 according to this embodiment of the invention is formed on the surface of the base 3*c* of a firing section 3*b* except for the tip 3*a*. Heat-resistant paraffins and paraffinic hydrocarbons may be used as the paraffin component.

As in Example 1, 100 cc of a saturated solution of solid paraffin in trichloroethylene was mixed with 10 cc of silicone oil. An insulating coating 4 was formed by applying the resulting coating solution on surfaces of the firing section of a porcelain insulator except for the top 6 mm. The insulator was left to stand for 24 hours and installed in a metal coating. The resulting plug was identified as sparkplug K. A control sparkplug L was prepared in the same manner except that the coating solution was applied to the whole área of the firing surface of the porcelain insulator including the tip. Also, a prior art sparkplug M was prepared that had no insulation coating at all. The three samples were subjected to antifouling and self-cleaning tests with a 4-cycle engine passenger car. In the antifouling test, cycles composed of five periods of running at −10° C., six accelerations from 10 km/hr to 20 km/hr and decelerations from 20 km/hr to 10 km/hr, and an idle period of five minutes were repeatedly carried out. The insulation resistance of the prior art sparkplug M decreased to less than 10 MΩ after 5 to 6 testing cycles. However, the insulation resistance of the sparkplugs K and L decreased to only 1000 MΩ after 10 testing cycles and proved to have very good antifouling properties.

In the self-cleaning test, samples K, L and M having a uniform carbon deposit on the firing surface due to idling with rich air/fuel mixture were used and tested under road self-cleaning conditions. The tip of the firing section of the sparkplug L did not burn white unless the car was run at 60 km/hr (a thermocouple plug indicated that the temperature of the tip of the central electrode was about 540° C.), whereas the same tip of the sparkplugs K and M burnt white only when the car was driven at 50 km/hr (the temperature of the tip of the central electrode was about 500° C.). Therefore, any decrease in the self-cleaning property of a sparkplug can be prevented by simply forming an insulation coating on the whole surface of the porcelain insulator except for the tip.

Figure 5:
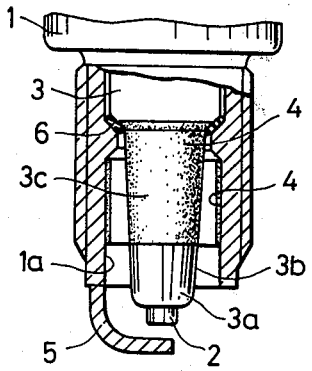
FIG. 5 is an enlarged view of part of FIG. 4.

In a modification of the second embodiment of the invention, the coating 4 may be formed not only on the surface of the base 3*c* of the firing section 3*b* of the porcelain insulator 3 except for its tip 3*a* but also on the inner surface 1*a* of the metal casing, as shown in FIG. 5. The intended object of the invention can also be achieved by forming the coating 4 only on the firing surface 3*b* as shown in FIG. 4. However, by forming the coating 4 on the inner surface layer 1*a* of the metal casing also, short-circuiting between the firing surface and the metal casing is prevented and the antifouling performance of the sparkplug is enhanced further.

As described above, the sparkplug of the invention has a coating of silicone oil and paraffin on at least the surface of the firing section, except for the tip, of a porcelain insulator. As a consequence, any decrease in insulation resistance is prevented to thereby achieve effective prevention of rapid fouling of the sparkplugs of a new car. Moreover, since any decrease in self-cleaning properties is also prevented, a car operated in urban areas can readily attain the self-cleaning stage, thus eliminating the possibilities of engine stoppage or difficulties in starting due to smoldering carbon deposits.

In a third embodiment of the invention, a sparkplug is provided that retains its antifouling properties for an extended period of time by the use of coating made of a solution of a highly heat-resistant, oil-and water-resistant fluorine oil containing elemental fluorine and, optionally, elemental silicon. The solution may also contain paraffin.

In accordance with the third embodiment of the invention, the coating 4 is formed of a solution of a fluorine oil containing elemental fluorine and optionally elemental silicon. The solution may further contain paraffin. Fluorine oil is more resistant to heat, oil and water than silicone oil. Particular advantages thereof are a low friction coefficient and low tackiness. Thus, the coating of fluorine oil on the surface of the firing leg of the porcelain insulator 3 provides very effective protection against the deposition of carbon and electrically conductive materials, and hence a sparkplug that will not smolder easily is provided. Addition of a small amount of paraffin increases the water-resistance and adhesion strength of the coating and provides a uniform patch-free coating having enhanced antifouling properties formed on the surface of the firing leg.

To form a uniform coating 4 on the surface of the base **3*b* of the firing leg of the porcelain insulator 3**, the fluorine oil is diluted with a solvent to a viscosity of less than 20 cSt, preferably between 1 and 15 cSt. Any solvent can be used that dissolves the fluorine oil. Advantageous examples include acetone, ketone, methyl ethyl ketone, trichloroethylene, chlorobenzene, toluene, trichlorotrifluoroethane, xylene, ligroin petroleum and benzene. All paraffinic hydrocarbon (sometimes collectively referred to as paraffins), in particular, higher paraffinic hydrocarbons, are used with advantage as paraffin since they have a high heat resistance.

EXAMPLE 2

Figure 6:
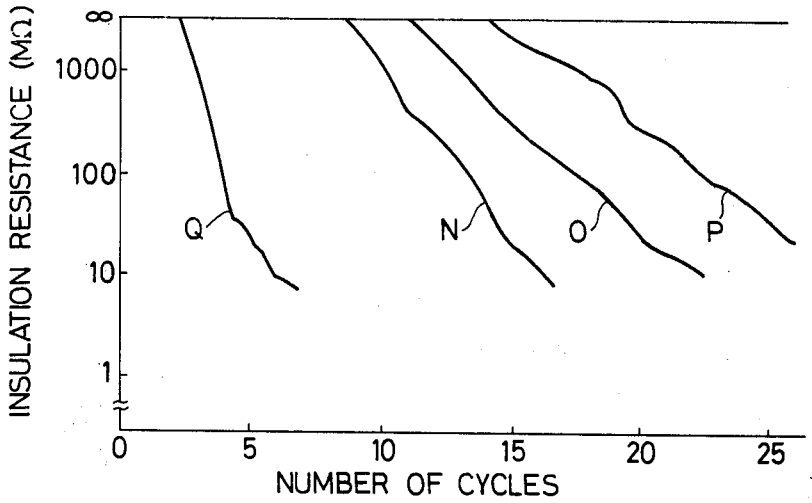
FIGS. 6 and 7 are graphs for comparing the performance of sparkplugs of the invention with prior art sparkplugs.
Figure 7:
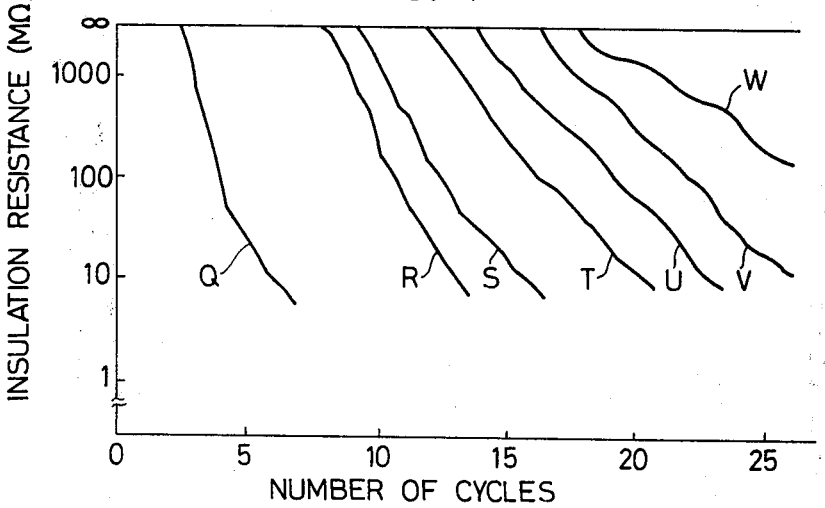

Fluorine oil (viscosity = 100 cSt) was mixed with acetone to prepare coating solutions N, O and P having viscosities of 1, 10 and 20 cSt, respectively. The coating solutions were applied to the surface of the base of the firing leg of porcelain insulators of the sparkplug construction shown in FIG. 1. The thus treated porcelain insulators were installed in metal casings to prepare sparkplugs N, O and P. The antifouling properties of the sparkplugs were compared with a prior art sparkplug Q having no coating on the surface of the firing leg. The results are set forth in FIG. 6. In the test, a 4-cycle single cylinder engine was used, and repeated cycles of a 50-second idling period (2070 rpm, $\frac{3}{4}$ choking) with rich air/fuel mixture, five racing periods at full throttle and an operation stop period of two minutes. As shown in FIG. 6, the sparkplugs N, O and P of the invention withstood far more testing cycles than prior art sparkplug Q and proved to have greatly improved antifouling performance.

For the formation of the desired coating, fluorine oil preferably having a viscosity of 1 to 20 cSt is used. Fluorine oil having a viscosity of less than 1 cSt forms a thin coating with patches and produces a sparkplug that is not stable in its antifouling performance. Fluorine oil having a viscosity of more than 20 cSt leads to the formation of an excessively thick coating that achieves no corresponding increase in antifouling performance, and hence is simply a waste of material.

EXAMPLE 3

Paraffin solutions (100 cc) of trichlorotrifluoroethane were mixed with 0.1, 1.5, 10, 30 and 70 cc of fluorine oil to prepare coating solutions R, S, T, U, V and W. The solutions were applied to the surface of the base of the firing leg of porcelain insulators which were installed in metal casings to prepare sparkplugs R to W. The sparkplugs were subjected to an antifouling test with the same engine and under the same conditions as in Example 2. The results are shown in FIG. 8 from which it can be seen that the sparkplugs R to W according to this embodiment of the invention had better antifouling properties than the prior art plug Q.

The objects of the invention can be achieved by providing a coating solution containing at least 0.1% of fluorine oil on the basis of paraffin solution and, preferably, 5 to 50% of fluorine oil is used. It is difficult to obtain a uniform coating with more than 50% of fluorine oil, and it simply results in a waste of material since no corresponding improvement in the antifouling performance is attained. Experiments have confirmed that the same result is obtained with the sparkplugs N to W when they were used in a commercial automobile (4-cycle, 1800 cc engine) that was subjected to repeated cycles of idling and low-speed running at 10–20 km/hr at a temperature of −10° C.

The reason that the coating 4 should be formed only on the base **3*a* of the firing leg 3*b* of the porcelain insulator 3 is because if the coating is formed on the tip of the firing leg 3*a***, the tip will not be cleaned of carbon deposits by itself unless the temperature of the tip becomes high.

In a modification of the third embodiment, a coating 4 is formed not only on the base of the firing leg **3*b* of the porcelain insulator 3 but also on the surface 1*a* of the inner part of the metal casing 1. The intended antifouling effect of the invention can be achieved by forming the coating 4 on the surface of the base of the firing leg of the porcelain insulator 3 alone. However, as described above, by forming the coating on the inner surface 1*a* of the metal casing also, short-circuiting between the firing surface and the metal casing is prevented, and the antifouling performance of the sparkplug is enhanced further. The coating 14 can be formed on both the surface of the base 3*b* of the firing leg and the inner surface 1*a*** of the metal casing by simply charging the coating solution into the annular space around the firing section of a porcelain insulator installed in the metal casing.

As described above, a sparkplug of this embodiment of the invention has a coating of fluorine oil and, optionally, paraffin on at least the surface of the base of the firing leg of a porcelain insulator. As a result, electrically conductive materials such as carbon and water are not easily deposited on the firing surface, and the insulation resistance between the electrodes is maintained high, thus providing effective protection against rapid fouling of the sparkplugs of a new car. Furthermore, since fluorine oil has a high resistance to heat, oil and water, the coating retains antifouling effects for an extended period of time, even for driving repeatedly at speeds that generate fairly high temperatures.

What is claimed is:

1. In a sparkplug having good antifouling properties wherein a porcelain insulator for supporting a central electrode is fixed in a metal casing, the improvement wherein a coating of silicone and paraffin is provided on at least a firing surface of said porcelain insulator surrounded by an inner surface of a combustion chamber side of said metal casing, thereby preventing a decrease in electrical resistance.

2. The sparkplug according to claim 1 wherein said solution is prepared by diluting silicone and paraffin with a solvent capable of a dissolving both silicone and paraffin.

3. The sparkplug according to claim 2 wherein said solvent is selected from the group consisting of trichloroethylene, chlorobenzene, trichlorotrifluoroethane, toluene, xylene, ligroin petroleum and benzene.

4. The sparkplug according to claim 1 wherein said paraffin comprises a material selected from the group consisting of paraffinic hydrocarbon and a eutectic mixture of paraffins with polyethylene, and a eutectic mixture of paraffins with polystyrene.

5. The sparkplug according to claim 4 wherein said coating is also formed on an inner surface of said metal casing.

6. The sparkplug according to claim 1 or 2 wherein said solution contains at least 0.1% of silicone oil on the basis of a saturated solution of paraffin.

7. The sparkplug according to claim 6 wherein said solution contains from 5 to 50% of silicone oil on the basis of a saturated solution of paraffin.

8. In a sparkplug wherein a porcelain insulator for holding a central electrode is fixed in a metal casing the improvement wherein a coating of a solution comprising silicone oil and a paraffin is formed on a firing surface except for a tip of said porcelain insulator surrounded by an inner surface of a combustion chamber side of said metal casing.

* * * * *